US005261337A

United States Patent [19]

Orita et al.

[11] Patent Number: 5,261,337

[45] Date of Patent: Nov. 16, 1993

[54] COMBUSTION CONTROL METHOD OF REFUSE INCINERATOR

[75] Inventors: Norihiko Orita; Hidetaka Ono; Masaharu Kira; Shizuo Yasuda, all of Yokohama, Japan

[73] Assignee: Mitsubishi Jukogyo Kabushiki Kaisha, Tokyo, Japan

[21] Appl. No.: 882,262

[22] Filed: May 13, 1992

[30] Foreign Application Priority Data

Jun. 21, 1991 [JP] Japan ..... 3-149156

[51] Int. Cl.[5] ..... F23G 5/00

[52] U.S. Cl. ..... 110/346; 110/103; 110/188; 110/190; 110/234; 110/297; 122/449; 236/14

[58] Field of Search ..... 110/188, 190, 346, 234, 110/103, 348, 297; 122/449; 236/14

[56] References Cited

U.S. PATENT DOCUMENTS 4,362,269 12/1982 Rastogi et al. ..... 236/14
4,574,746 3/1986 Keyes .
4,838,183 6/1989 Tsaveras et al. ..... 110/190
5,052,310 10/1991 Goff et al. ..... 110/234

FOREIGN PATENT DOCUMENTS 0413104 4/1984 European Pat. Off. .
55-88215 6/1980 Japan .
55-99514 7/1980 Japan .
59-221511 12/1984 Japan .

OTHER PUBLICATIONS

Patent Abstracts of Japan No. 8040(M-278) and JP-A-58 195 707 Feb. 1984.
Patent Abstracts of Japan No. 7126(M-219) and JP-A-58 043,323 Mar. 1983.
Patent Abstracts of Japan No. 8094(M-293) and JP-A-59 009 428 Jan. 1984.

*Primary Examiner*—Edward G. Favors
*Attorney, Agent, or Firm*—McAulay, Fisher, Nissen, Goldberg & Kiel

[57] ABSTRACT

The present invention aims for the object thereof at preventing unburnt gas and noxious gas components from being generated in a refuse incinerator, and provides a combustion control method by which it is arranged so that a feeder (2) and a stoker (3) are not only controlled so as to keep evaporation (S1) of the boiler at a target value thereby to achieve stabilized combustion extending over a long period of time, but also feed water quantity (S2) and the like from a boiler water pipe section (2) forming a combustion chamber (6) are detected, and the rate of overfire air quantity to main combustion air quantity to a lower part of the stoker is controlled at a constant total gas capacity so that the fluctuation width of the feed water quantity (S2) falls within a set range.

3 Claims, 5 Drawing Sheets

COMBUSTION CONTROL METHOD OF REFUSE INCINERATOR

FIELD OF THE INVENTION AND RELATED ART STATEMENT

The present invention relates to an improvement of a method of controlling the combustion of refuse burning in a solid fuel boiler and the like of an incinerator.

Apparatuses are known for performing combustion control of an incinerator by detecting the total amount of vapor generated in the boiler and keeping the amount close to a target value. Such apparatuses have been widely put into operation. Further, the present applicant has previously proposed combustion control apparatuses of this sort, which have been laid open already in Japan as Japanese Patent Provisional Publication No. 55-82215, Japanese Patent Provisional Publication No. 55-99514 and Japanese Patent Provisional Publication No. 59-221511.

A conventional combustion control apparatus of this sort will be described with reference to FIG. 6. This figure shows a section and a control system of a refuse incinerator and a boiler.

In FIG. 6, refuse 101, such as municipal refuse, supplied to a hopper chute 1 is fed onto a stoker (a combustion fire grate) 3 by a feeder 2 provided at a lower part of the hopper chute. Further, main combustion air is sent to a compartment wind box 5 at a lower part of the stoker by a blower 8 and fed to the stoker 3. Distribution of the main combustion air on the stoker 3 is adjusted by controlling the opening of a damper 4 with a manual damper opening setting unit 14. On the other hand, overfire air is fed to a lower part of a combustion chamber 6 on the stoker 3 by means of a blower 10. The distribution of the main combustion air and the overfire air is set manually by controlling a variable speed motor 9 of the blower 8 and a variable speed motor 11 of the blower 10 while monitoring the combustion. Comnustion exhaust gas of a high temperature produced by combustion on the stoker 3 is led to a panel section 102 of boiler water pipes which forms the combustion chamber 6, and generates steam through heat exchange there.

The total evaporation S1 of the boiler is measured by a flowmeter 17 provided in an outlet piping 103 of a steam drum 7, and sent to a computing unit 16 as a signal. The computing unit 16 compares the total evaporation S1 of the boiler with a set value given by a setting unit 15 and converts the value S1 into a driving signal for a feeder drive unit 12 and a stoker drive unit 13. The movement of the feeder drive unit 12 and the stoker drive unit 13 is made inactive by the driving signal if the total evaporation S1 of the boiler is larger than the set value, and the movement of both drive units 12 and 13 is made active if the value S1 is smaller than the set value. Namely, the above-described driving signal increases the quantity of refuse supplied onto the stoker 3 by the feeder 2, and the degree of agitation of refuse which is burning on the stoker 3. With this, the total evaporation S1 of the boiler is kept at a set target value.

By controlling the movement of the feeder 2 and the stoker 3 to as to keep the total evaporation S1 of the boiler constant the quantity of heat inputted to the boiler can be controlled to be constant, and a thermal load in the reactor is maintained to stay constant as seen from the view point of the refuse incinerator. Therefore, it is an excellent combustion control method for preventing an excessive rise of the reactor temperature lasting over an extended period of time.

However, if the quantity of the refuse supplied and the degree of agitation of the burning refuse are changed by moving the feeder 2 and the stoker 3, a considerable time delay occurs until the effects thereof appear as a variation of the total evaporation S1 of the boiler. Therefore, it is difficult to respond to sudden changes of a combustion state caused by variations of the refuse quality.

That is to say, even when the combustion in the refuse incinerator is stable macroscopically, an unstable state may continue microscopically, and carbon monoxide and hydrocarbons occur as combustible gas due to local shortage of oxygen. Further, chlorobenzenes, chlorophenols and dioxins are generated from chlorine components and organic substances in the refuse, and might be exhausted outside before thermal decomposition is finished completely in the reactor. These cannot be dealt with completely by the control of the feeder 2 and the stoker 3 based on the total evaporation S1 of the boiler.

OBJECT AND SUMMARY OF THE INVENTION

It is an object of the present invention to provide a combustion control method of a refuse incinerator in which problems associated with the above-described conventional art are solved.

A combustion control method of a refuse incinerator according to the present invention is characterized in that the amount of feed water, the amount of evaporation, and an evaporation level and the like in a boiler water pipe panel section which forms a combustion chamber of a refuse incinerator are measured, and the ratio of the quantity of overfire air to that of main combustion air blasted into the lower part of the stoker is controlled so that a fluctuation width of measured values falls within a set range.

In order to maintain the combustion stable on average over a long period of time, it is sufficient to control the movement of the feeder and the stoker so as to keep the above-mentioned total evaporation of the boiler at a constant target value. Against a sudden change of the combustion state in a short period of time, however, it is effective to stabilize the combustion of combustibles, those gasified in particular, which are present in the refuse by controlling the quantity of the combustion air which can influence combustion reactions with high responsiveness.

For the signal used for the air quantity control, one which sensitively follows the change of the combustion state is appropriate. Therefore, the signal should be obtained from a boiler water pipe panel section forming a combustion chamber instead of the total evaporation of the boiler. To generate a signal for the air quantity control, the quantity of feed water fed to the boiler water pipe panel section, the evaporation from this panel section, and the evaporation level in the panel section are measured and used. Furthermore, the combustion air is divided into main combustion air fed from the lower part of the stoker and overfire air fed to the combustion chamber, but the overfire air among them is effective for the complete combustion and thermal decomposition of combustible and noxious gas components produced by localized incomplete combustion, and also contributes to making uniform the thermal load in the combustion chamber. So, if the widths of changes in the feed water quantity, the evaporation or the evaporation level in a boiler water pipe panel are contained within a set range by controlling the ratio of the overfire air quantity to the main combustion air quantity, it is possible to achieve perfect combustion and thermal decomposition of combustible and noxious gas components caused by local unstable combustion occurring in a short period of time.

DETAILED DESCRIPTION OF PREFERRED EMBODIMENTS

Embodiments of the present invention will be described hereinafter with reference to FIG. 1 to FIG. 5.

Figure 1:
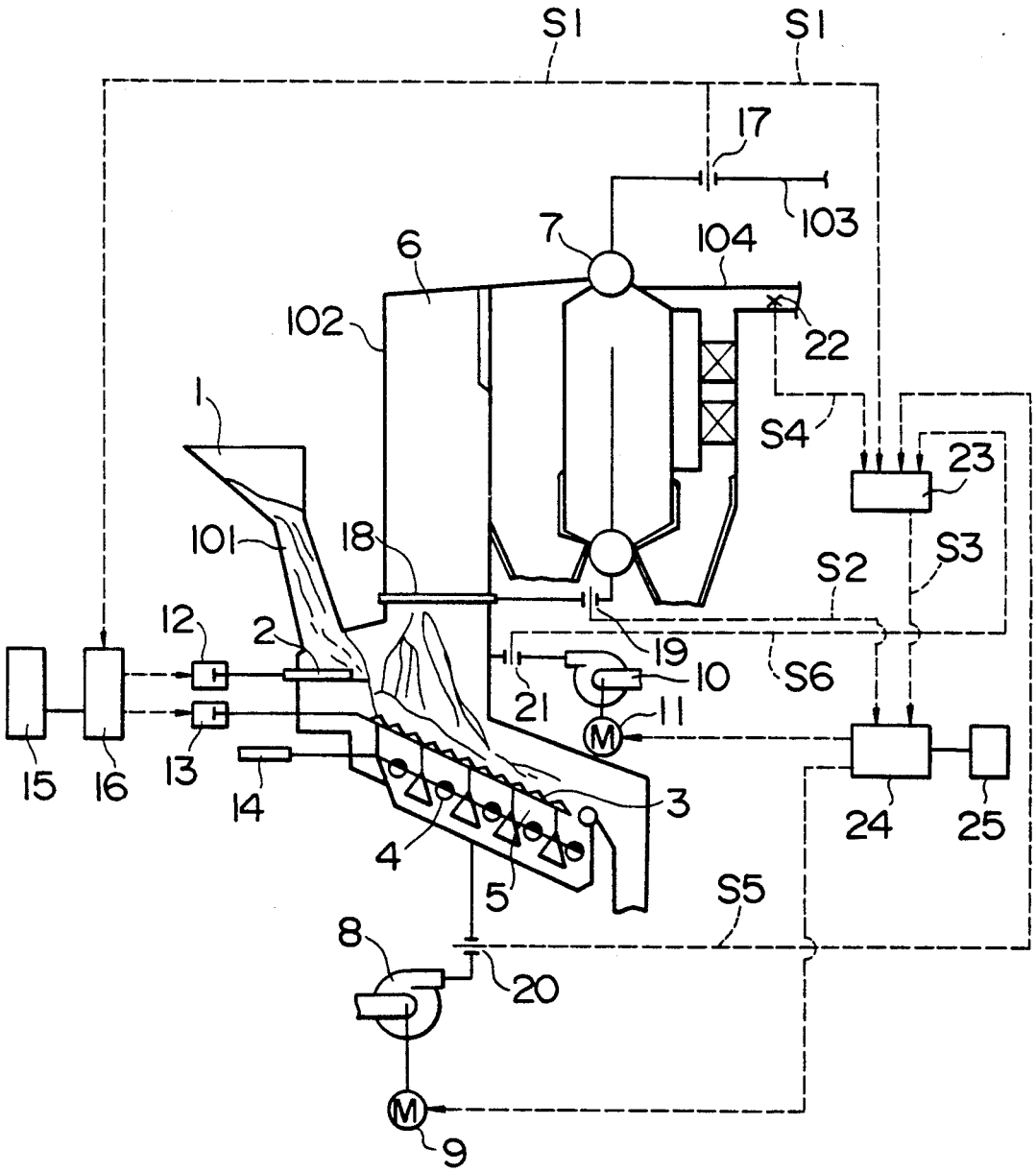
FIG. 1 shows a section and a control system of a refuse incinerator and a boiler according to an embodiment of the present invention.
Figure 6:
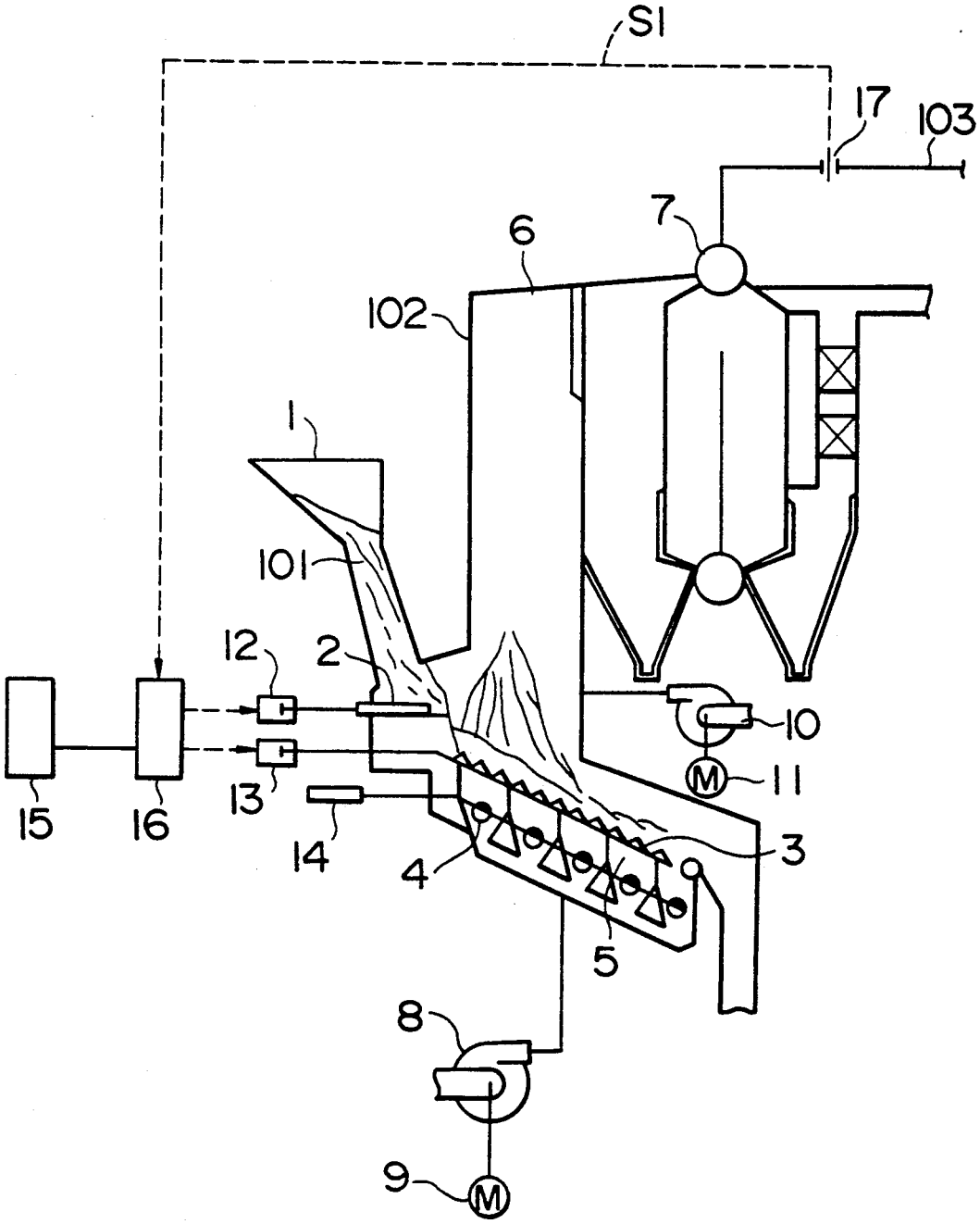
FIG. 6 PRIOR ART
FIG. 6 shows a conventional example.

FIG. 1 shows the whole refuse incinerator in which combustion air is controlled by the method of combustion control of the present invention, but the parts except those that are related to combustion air control are the same as those of a conventional apparatus shown in FIG. 6, hence the same symbols are assigned to the same functional parts and duplication of description is omitted.

The outline of the whole apparatus will be described first with reference to FIG. 1. Refuse 101, such as municipal refuse, supplied to a hopper chute 1 is fed onto a stoker (a combustion fire grate) 3 by a feeder 2 provided at a lower part of the hopper chute. Further, main combustion air is sent to a compartment wind box 5 at a lower part of the stoker by a blower 8 and fed to the stoker 3. The distribution of the main combustion air on the stoker 3 is performed by controlling the opening of a damper 4 by means of a manual damper opening setting unit 14. On the other hand, the overfire air is fed to a lower part of a combustion chamber 6 on the stoker 3 by means of a blower 10. The total quantity of combustion air which is the sum of the combustion air quantity and the overfire air quantity as well as the distribution ratio between them are set automatically by controlling speeds of a veriable speed motor 9 of the blower 8 and a variable speed motor 11 of the blower 10 while monitoring the combustion. Combustion exhaust gas of a high temperature produced by combustion on the stoker 3 is led to a boiler water pipe panel section 102 forming a combustion chamber 6, and generates steam through heat exchange there.

First, in order to control the movement of the feeder 2 and the stoker 3 for maintaining the total evaporation S1 of the boiler at a target value, the total evaporation S1 of the boiler is measured by a flowmeter 17 provided in an outlet piping 103 of a steam drum 7 and sent to a computing unit 16 as a signal in the same manner as before. The computing unit 16 compares the total evaporation S1 of the boiler with a set value given by a setting unit 15, and converts the result into a driving signal for a feeder drive unit 12 and a stoker drive unit 13.

Figure 2:
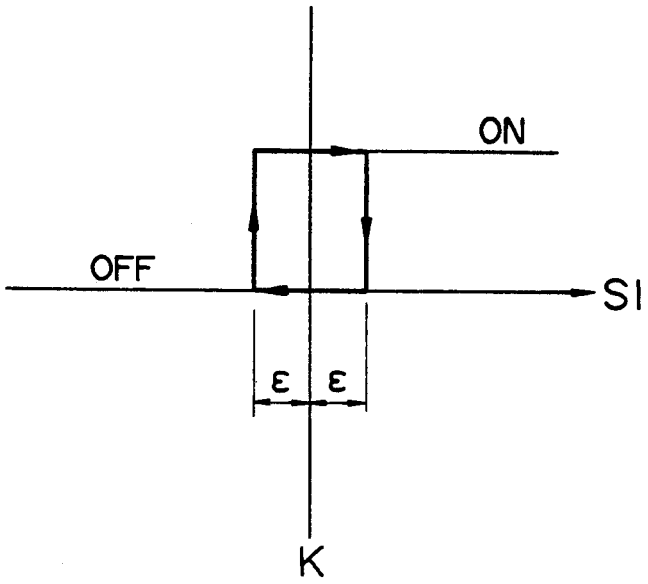
FIG. 2 shows an example of a computing unit 16 for controlling a feeder and a stoker.

The computing unit 16 in the present embodiment is a reverse hysteresis type ON/OFF controller as shown in FIG. 2. By controlling the number of times the feeder 2 moves and the moving speed of the stoker 3 in this manner, the supply of the refuse and the agitation of the refuse during combustion are changed so as to prevent the thermal load of the combustion chamber 6 from becoming excessive for a long period of time, thereby to keep the adhesion of clinker to a reactor wall and corrosion at a high temperature of a combustion apparatus within an allowable range.

Here, the function of the computing unit 16 will be described with reference to FIG. 2.

FIG. 2 shows an ON signal and an OFF signal outputted to the drive units 12 and 13 from the computing unit 16 while it is assumed that the set value of the setting unit 15 is K and the deviation thereof is $\epsilon$. Four types of output contents are shown in FIG. 2.

(1) When $S1-K>+\epsilon$, an ON signal is outputted.
(2) When $S1-K<-\epsilon$, an OFF signal is outputted.
(3) When the signal is OFF and $-\epsilon \leqq S1-K \leqq +\epsilon$, an ON signal is subsequently outputted.
(4) When the signal is ON and $-\epsilon \leqq S1-K \leqq +\epsilon$, an OFF signal is subsequently outputted.

Incidentally, the above-described set value K is determined based on S1 as a reference, and is determined univocally by the target set value which is a function f of W when the refuse incineration quantity W (ton/day) is determined.

Further, since S2 and S7 cannot be computed before hand, it is sufficient that a mean value and a standard deviation during a steady operation at the above-described target set value are actually measured, and the setting range is set, for example, to be $k \cdot \sigma$ for instance based on these values. Here, k is a constant and $\sigma$ is a standard deviation.

In the present embodiment, a sudden change of the combustion state in a short period of time is detected from the quantity of the feed water supplied to the boiler water pipe panel section 102. The quantity S2 of the feed water supplied to a header 18 of the boiler water pipe panel section of the combustion chamber 6 is detected using a flowmeter 19, and this signal is given to a computing unit 24. Namely, this is because if the combustion state varies wholly or locally in a short period of time due to changes in the components and combustibility of the refuse, then the thermal load varies in the combustion chamber 6, the quantity of thermal radiation to the boiler water pipe panel section 102 which constitutes the combustion chamber 6 varies, the evaporation from the boiler water pipe panel section 102 varies correspondingly, and the feed water quantity S2 to the header 18 of the boiler water pipe panel section also varies. Accordingly, the evaporation at the boiler water pipe panel section 102, instead of the feed water quantity S2, can also be measured to detect the combustion state.

Further, according to the present embodiment, in order to automatically control the total combustion air quantity S3, not only the total evaporation S1 of the boiler is measured by means of the flowmeter 17 provided in the outlet piping 103, but also exhaust gas oxygen concentration S4 is measured by an oxygen analyzer 22 provided in a boiler outlet combustion tunnel 104. Further, main combustion air quantity S5 and overfire air quantity S6 are measured by respective flowmeters 20 and 21 provided at the outlets of two blowers 8 and 10. The measured values of these S1, S4, S5 and S6 are given to a computing unit 23 so as to compute the total combustion air quantity S3.

Figure 3:
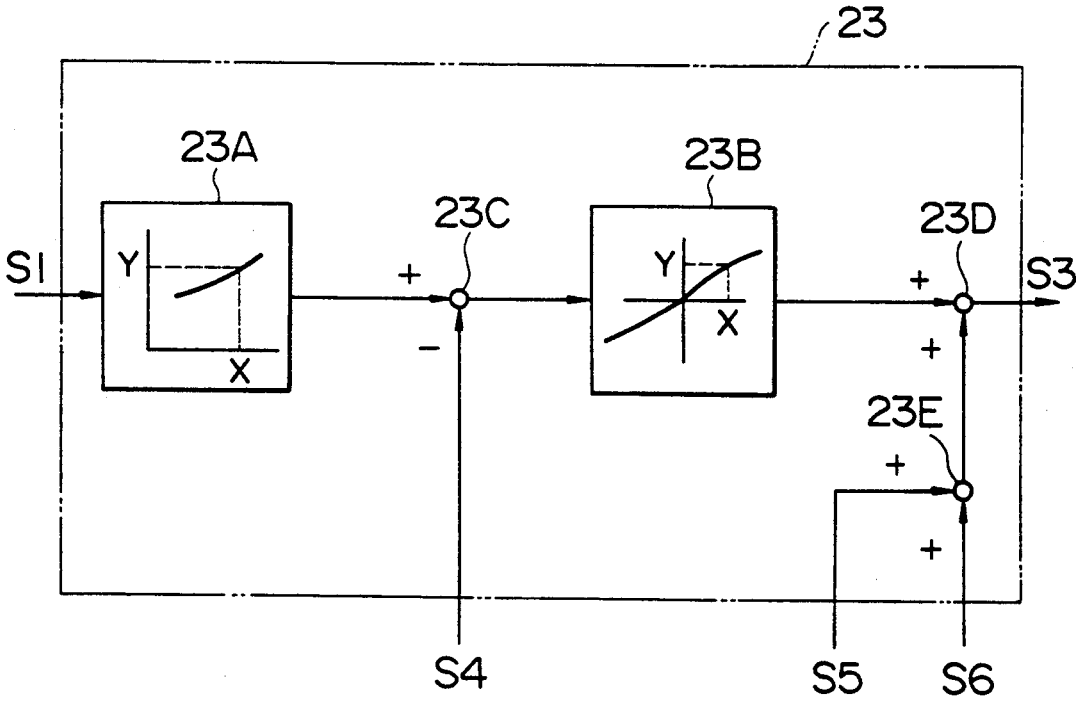
FIG. 3 shows an example of a computing unit 23 for computing the total quantity of combustion air.

As shown in FIG. 3, the computing unit 23 is composed of two sets of function computing units (converters) 23A and 23B and three sets of adder-subtractors 23C, 23D and 23E. The quantity of oxygen corresponding to the total evaporation S1 of the boiler is obtained with the computing unit 23, and the exhaust gas oxygen concentration S4 is subtracted therefrom. Then the air quantity corresponding to the difference is obtained, and air quantities S5 and S6 from the blowers 8 and 10 are added to this air quantity so as to obtain the total air quantity S3 required theoretically for combustion.

In order to contain the fluctuation of the feed water quantity S2 within a target range indicated by a setting unit 25, the above-mentioned computing unit 24 computes the ratio of the main combustion air quantity S5 to the overfire air quantity S6 in accordance with a value indicated by the setting unit 25 while keeping the total air quantity S3 at a value computed by the computing unit 23. Based on the result of this arithmatic operation, the speed control of the variable speed motor 9 of the main combustion air blower 8 and the variable speed motor 11 of the overfire air blower 10 is performed. To be more specific, the computing unit 24 is composed of two sets of function computing units (converters) 24A and 24B and four sets of multipliers 24C to 24F, and performs operation for increasing the ratio of the overfire air quantity when the feed water quantity S2 is large and corrects the speeds of the variable speed motors 9 and 11 at every control interval of a predetermined short period of time on the basis of a correction factor indicated by the setting unit 25.

Figure 4:
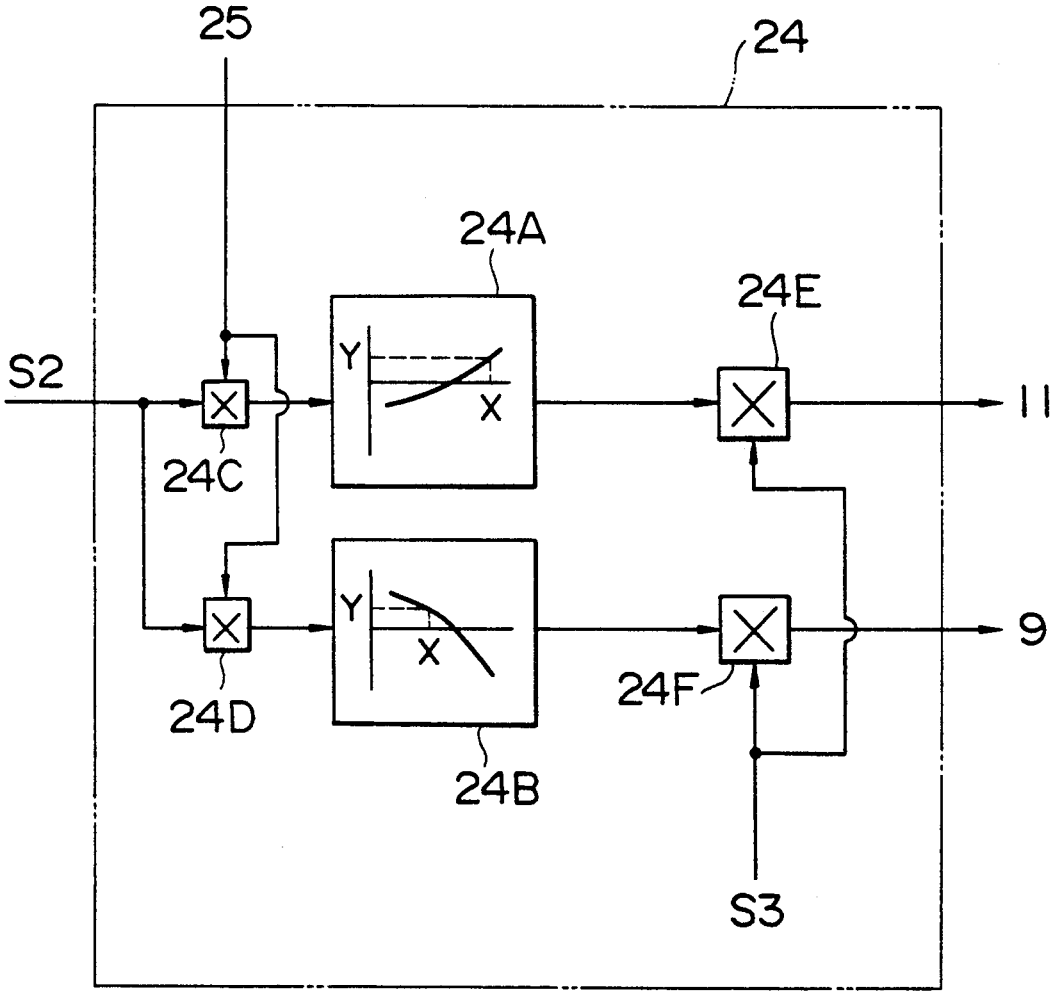
FIG. 4 shows an example of a computing unit 24 for computing a ratio of main combustion air quantity to overfire air quantity.

Here, the functions of the computing units 23 and 24 will be described referring to FIGS. 3 and 4. Graphs 23A, 23B, 24A and 24B in FIGS. 3 and 4 show a function for calculating a value of a characteristic curve corresponding to a given input value $X_1$ and outputting it as an output Y.

Incidentally, it is preferable that the shapes and inclinations of the characteristic curve of respective functions are adjusted appropriately based on the results of actual operations.

In the computing unit 23, the evaporation S1 is a value representing the load of the incinerator, and the target value of $O_2$ concentration is determined as an index by the function 23A in order to find the air quantity corresponding to the value.

As adder 23C performs subtraction in proportion to an increase of the $O_2$ concentration S4 so that S4 in the exhaust gas coincides with the target value of the above-mentioned $O_2$ concentration.

The function 23B gives a magnification against a signal inputted thereto. The output of the function 23B indicates a corrected air quantity for making the $O_2$ concentration constant. This output is added to the total air quantity (S5+S6) at the adder 23D to perform adjustments.

The computing unit 24 generates a speed change signal for the variable speed motors 11 and 9 with the above-mentioned air quantity and correction quantity.

Incidentally, in the present invention, it is preferred to control the ratio of the overfire air quantity to the main combustion air quantity on the basis of a fluctuation of the evaporation S1 and the feed water quantity S2 as in the present embodiment.

The control in such a case will be described in the following.

(1) When S1 and S2 are both large, the feeder 2 and the stoker 3 are set to the OFF state so as to increase the overfire air quantity, thereby to reduce the main combustion air quantity.

(2) When S1 is small and S2 is also small, the feeder 2 and the stoker 3 are set to the ON state so as to reduce the overfire air quantity, thereby to increase the main combustion air quantity.

(3) When S1 is large and S2 is small, the feeder 2 and the stoker 3 are set to the OFF state, and the ratio of the overfire air quantity to the main combustion air quantity depends on the result of multiplication by the multipliers 24E and 24F.

(4) When S1 is small and S2 is large, the feeder 2 and the stoker 3 are set to the ON state, and the ratio of the overfire air quantity to the main combustion air quantity depends on the result of multiplication by the multipliers 24E and 24F.

In another embodiment, if the evaporation from the boiler water pipe panel section 102 is measured instead of the feed water quantity S2, the resulting signal is applied to the computing unit 24 as S2. Further, the feeder drive unit 12 is controlled so as to reduce the supply of the refuse when the evaporation remains to be large over a long period of time. Whereas, if the evaporation becomes large only for a short period of time, the speeds of the variable speed motors 9 and 11 are corrected at every control interval so as to increase the ratio of the overfire air quantity while keeping the total air quantity constant. When the evaporation is large for a short period of time.

Figure 5:
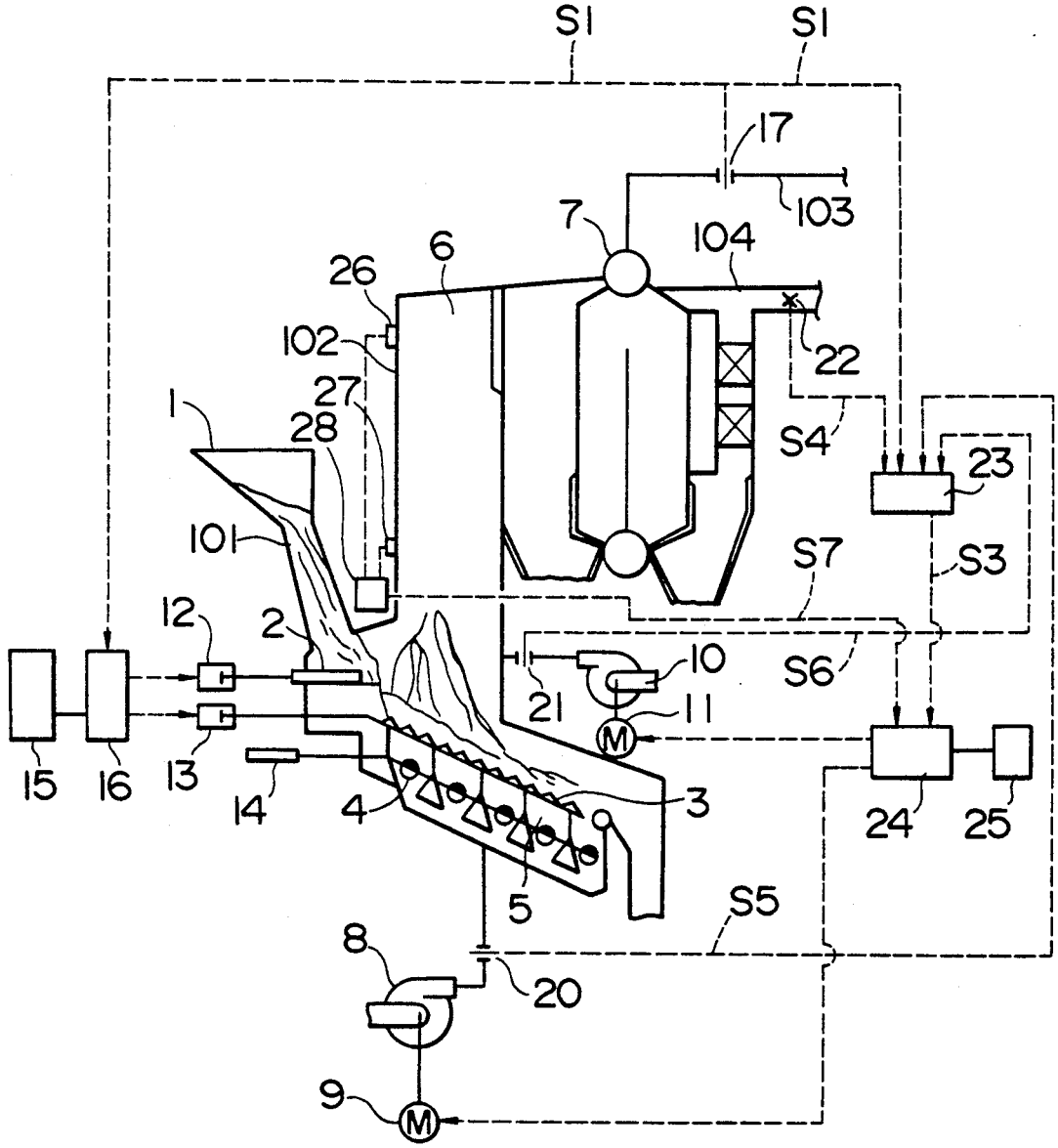
FIG. 5 shows another embodiment of the present invention.

In an embodiment shown in FIG. 5, an evaporation level S7 is measured instead of the feed water quantity S2 supplied from the boiler water pipe panel section 102 so as to control the ratio of the overfire air quantity to the main combustion air quantity as compared with the embodiment shown in FIG. 1. The rest is the same.

Lower water pipes of the boiler water pipe panel section 102 forming the combustion chamber 6 of a refuse incinerator are filled with water, upper water pipes thereof are filled with steam, and an evaporation level exists therebetween. Since the evaporation level descends if the thermal load of the combustion chamber 6 becomes high and ascends if it becomes low, it is possible to perform combustion control by using this phenomenon. Namely, when the combustion state changes wholly or locally in a short period of time due to a certain change of components and combustibility of the refuse, the thermal load in the combustion chamber 6 fluctuates. Then the quantity of radiative heat to the boiler water pipe panel section 102 changes, and the evaporation level S7 of the boiler water pipe panel section 102 changes in accordance with the change of the radiative heat quantity. This evaporation level S7 is located by sound meters 26 and 27 and a computing unit 28.

When noises of a fluid flowing in the boiler water pipe are measured with a sound meter, they show stronger low frequency components if the inside is water, and show stronger high frequency components if the inside is steam. Thus, it is possible to find fluctuating ups and downs of the evaporation level S7 by performing arithmatic operations on the basis of fluctuations and relative differences in the sound frequency spectra of the water part and the steam part.

Thus, the sound meters 26 and 27 are provided at an upper part and a lower part of the boiler water pipe panel section 102, respectively, signals thereof are inputted to a computing unit 28. The computing unit 28 determines the height of the evaporation level in the boiler water pipe panel section 102, and a signal about the evaporation level S7 obtained therefrom is applied to the computing unit 24 for combustion air control.

The computing unit 24 computes the distribution of the main combustion air quantity S5 and the overfire air quantity S6 in accordance with an indicated value (a correction factor) of the setting unit 25 while keeping the total air quantity S3 at a value computed by the computing unit 23. The speed control of the variable speed motor 9 of the main combustion air blower 8 and the variable speed motor 11 of the overfire air blower 10 is performed on the basis of the result of above computation. The ratio of the overfire air quantity is reduced when the evaporation level S7 is high.

The control of the computing unit 16 of the feeder 2 and the stoker 3 for maintaining the total evaporation S1 of the boiler at a target value, as well as the computation of the total combustion air quantity S3 required theoretically based on the total evaporation S1 of the boiler, the exhaust gas oxygen concentration S4, the main combustion air quantity S5 and overfire air quantity S6 by means of the computing unit 23, is the same as in the embodiment shown in FIG. 1.

According to the present invention, measured are the feed water quantity, the evaporation, the evaporation level and the like at the boiler water pipe panel section, which have sensitive combustion reaction responsiveness against a sudden change of the combustion state. The ratio of the overfire air quantity to the main combustion air quantity in the air blasted into the lower part of the stoker is controlled so that the fluctuation width of a measured value falls within a set range. Accordingly, it is possible to perform complete combustion and decomposition of unburnt and noxious gas components caused by locally or wholly unstable combustion occurring in a short period of time, in addition to unstable combustion lasting for a long period of time of a conventional refuse incinerator.

What is claimed is:

1. A combustion control method of a refuse incinerator, comprising the steps of:

detecting at least one of total evaporation (S1) feed water quantity (S2) and evaporation level (S7) at a boiler water pipe panel section forming a combustion chamber of a refuse incinerator; and controlling a ratio of overfire air quantity to main combustion chamber air quantity so that the fluctuation of the detected value falls within a set range.

2. A combustion control method of a refuse incinerator, comprising the steps:

detecting total evaporation (S1) at a boiler water pipe panel section forming a combustion chamber of a refuse incinerator and feed water quantity (S2) to said boiler water pipe panel section; and controlling a ratio of overfire air quantity to main combustion air quantity so that the overfire air quantity is increased when said feed water quantity (S2) is large than a set value and the main combustion air quantity is increased when said feed water quantity (S2) is smaller than the set value.

3. A combustion control method of a refuse incinerator, comprising the steps of:

detecting total evaporation (S1) and evaporation level (S7) at a boiler water pipe panel section forming a combustion chamber of a refuse incinerator; and controlling a ratio of overfire air quantity to main combustion air quantity so that the overfire air quantity is reduced when said evaporation level (S7) is higher than a set value and the main combustion air quantity is reduced when said evaporation level (S7) is lower than the set value.

* * * * *